US005713475A

United States Patent [19]

Wang

[11] Patent Number: 5,713,475

[45] Date of Patent: Feb. 3, 1998

[54] MULTI-PURPOSE DISPLAYING STAND

[75] Inventor: Johnny Wang, Yun-Lin Hsien, Taiwan

[73] Assignee: Enhance Holding Corp., Taipei, Taiwan

[21] Appl. No.: 623,816

[22] Filed: Mar. 29, 1996

[51] Int. Cl.[6] ..... A47F 7/00

[52] U.S. Cl. ..... 211/163; 211/40

[58] Field of Search ..... 211/163, 40, 13, 211/88

[56] References Cited

U.S. PATENT DOCUMENTS

| | | | |
|---|---|---|---|
| 5,253,767 | 10/1993 | Koeppel | 211/40 |
| 5,460,275 | 10/1995 | Ladwig | 211/40 |
| 5,584,398 | 12/1996 | Lin | 211/40 |

*Primary Examiner*—Alvin C. Chin-Shue
*Assistant Examiner*—Sarah L. Purol
*Attorney, Agent, or Firm*—Johnny Wang

[57] ABSTRACT

A multi-purpose displaying stand including a body portion having a rectangular opening at an upper portion thereof, an electrical receptacle arranged within a lower portion of the body portion, a power switch electrically connected with the electrical receptacle and fitted at one side of the body portion, an electrical socket installed at another side of the body portion, a transparent frame fixedly fitted within the rectangular opening of the body portion, a neon light mounted within the transparent frame, and a rotatable holder pivotally fitted within the transparent frame and having an inverted U-shaped top panel, a U-shaped bottom panel, a first and a second vertical panels between the top and bottom panels, whereby an article such a poster, compact disk or the like can be attractively displayed in the rotatable holder.

4 Claims, 5 Drawing Sheets

MULTI-PURPOSE DISPLAYING STAND

BACKGROUND OF THE INVENTION

1. Field of the Invention

This invention relates to a multi-purpose displaying stand.

2. Description of the Prior Art

It has been found that the conventional way to display an article such as a picture, a photograph, a compact disk, or the like is to put it into a simple frame. However, such a simple frame has no other function than keeping an article in place. Hence, various kinds of display frame have been developed to eliminate this defect, but none of them is satisfactory in use.

Therefore, it is an object of the present invention to provide a multi-purpose displaying stand which can obviate and mitigate the above-mentioned drawbacks.

SUMMARY OF THE INVENTION

This invention relates to a multi-purpose displaying stand.

It is the primary object of the present invention to provide a multi-purpose displaying stand which can be used for showing different kinds of commodities.

It is another object of the present invention to provide a multi-purpose displaying stand having a freely rotatable holder.

It is still another object of the present invention to provide a multi-purpose displaying stand which is easy and cheap to manufacture.

It is still another object of the present invention to provide a multi-purpose displaying stand which may be placed at the market at a very low cost.

It is a further object of the present invention to provide a multi-purpose displaying stand which is simple and sturdy in construction.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
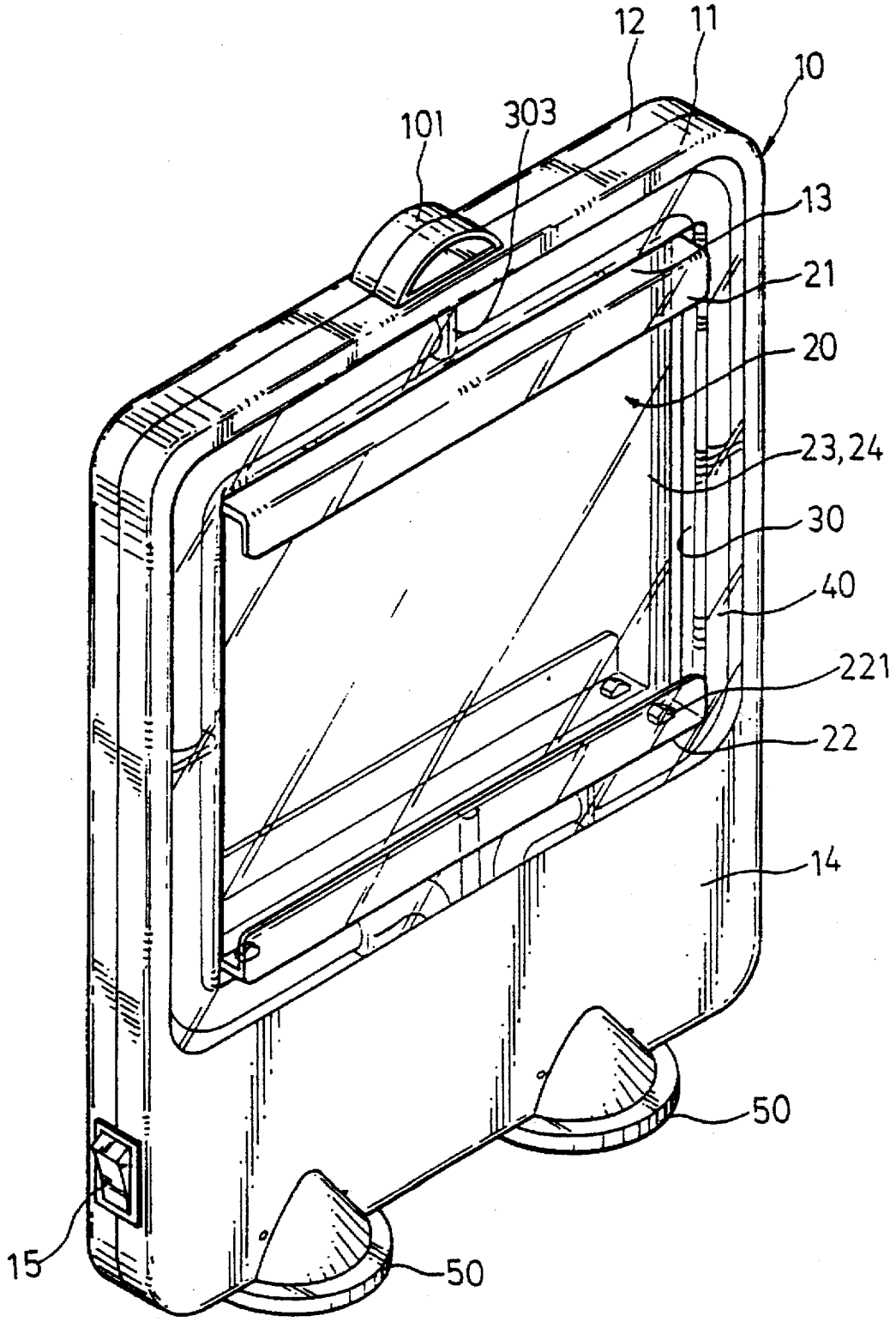
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
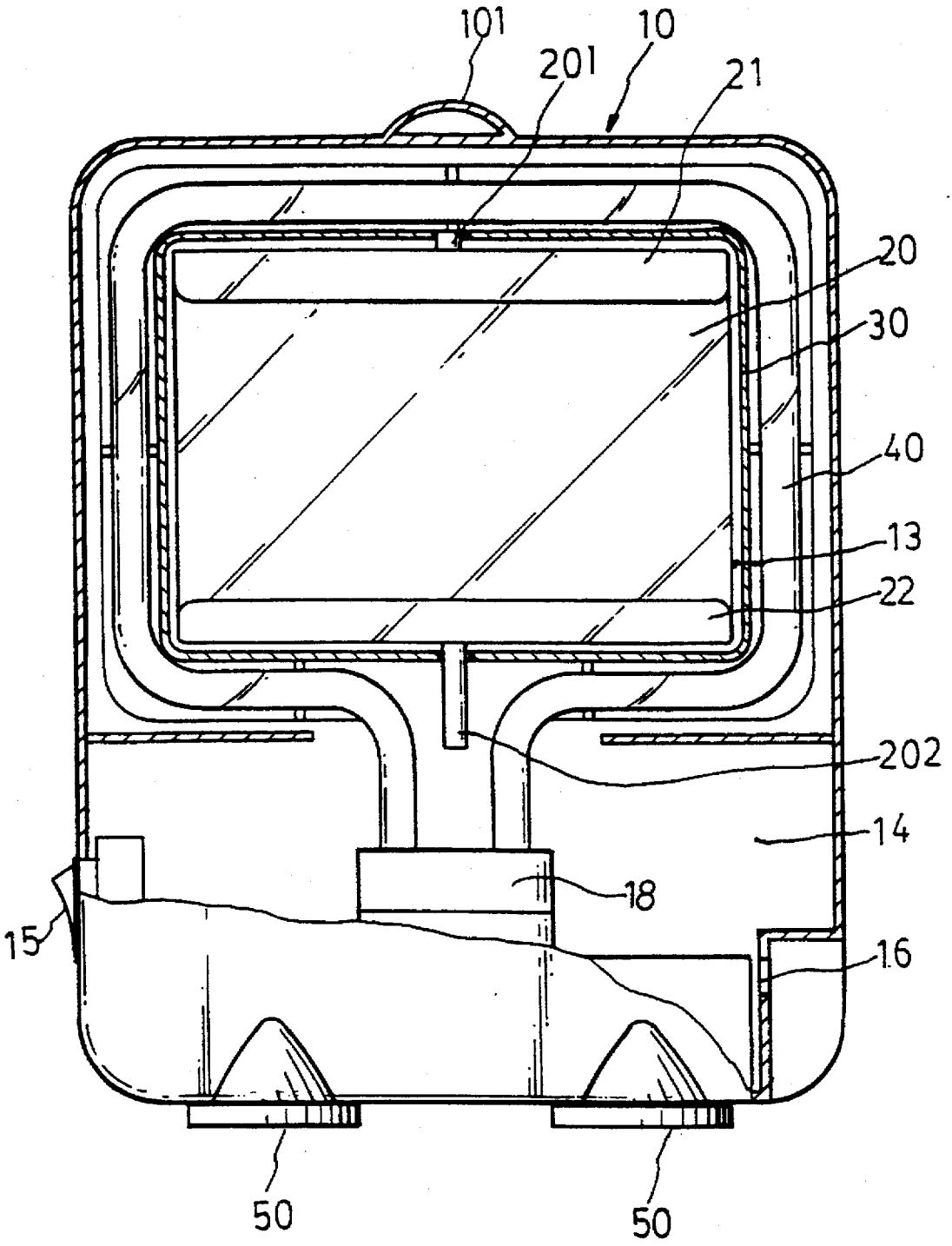
FIG. 2 is a sectional view of the present invention.

With reference to the drawings and in particular to FIGS. 1 and 2 thereof, the multi-purpose displaying stand according to the present invention mainly comprises a body portion 10, a rotatable holder 20, a transparent frame 30, a neon light 40, and two bases 50.

The body portion 10 is composed a front half 11 and a rear half 12 provided with a plurality of holding members and has a rectangular opening 13 at the upper portion. An electrical receptacle 18 (see FIG. 2) for receiving the neon light 40 is arranged within the lower portion 14 of the body portion 10. A power switch 15 is fitted at one side of the body portion 10, while an electrical socket 16 is installed at the other side of the body portion 10. The power switch 15 is electrically connected with the electrical receptacle 18. A hook portion 101 is provided at the upper side of the body portion 10.

The transparent frame 30 is fixedly fitted within the opening 13 of the body portion 10. The transparent frame 30 is provided with a plurality of holding members 303 so that the neon light 40 can be kept in place within the transparent frame 30. The terminals of the neon light 40 extend downwardly into the lower portion of the body portion 10 to connect with the electrical receptacle 18.

The rotatable holder 20 is fitted within the transparent frame 30 and has an upper pin 201 and a lower pin 202 pivotally mounted between the upper side and lower side of the transparent frame 30 so that the rotatable frame 30 can be freely rotated with respect to the transparent frame 30. The rotatable holder 20, which is preferably made of transparent material, is a rectangular member formed with an inverted U-shaped top panel 21, a U-shaped bottom panel 22, a front vertical panel 23 and a rear vertical panel 24 between the top and bottom panels 21 and 22 thereby dividing the holder 20 into a front frame and a rear frame. Between the front vertical panel 23 and the rear vertical panel 24 there is a slot 25. The bottom panel 22 is provided with two protuberances 221 close to both ends thereof. Hence, photographs, pictures, compact discs or the like can be conveniently inserted into the front and rear frames of the rotatable holder 20 for display.

Figure 3:
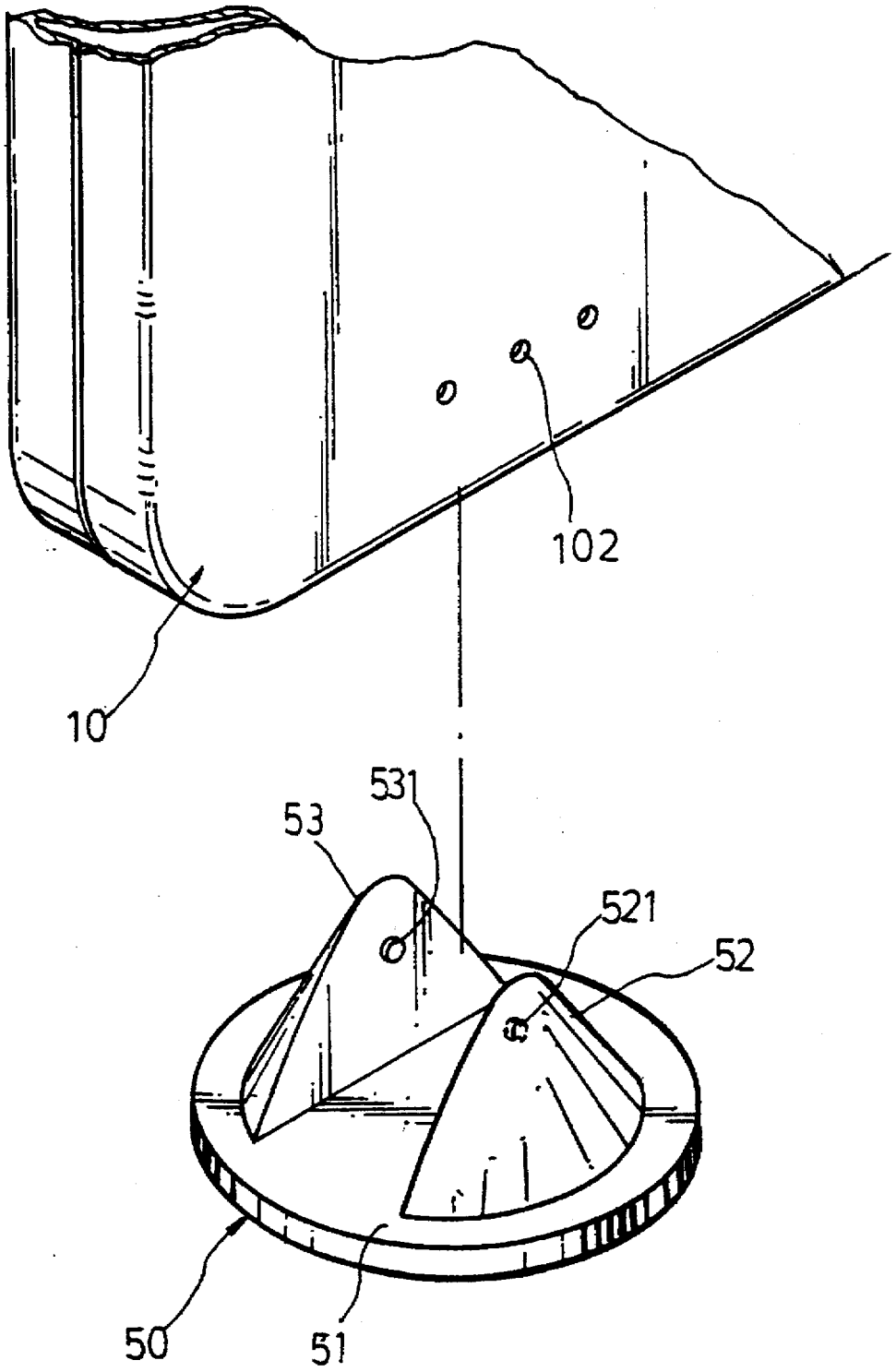
FIG. 3 is an enlarged fragmentary view of the present invention.
Figure 4:
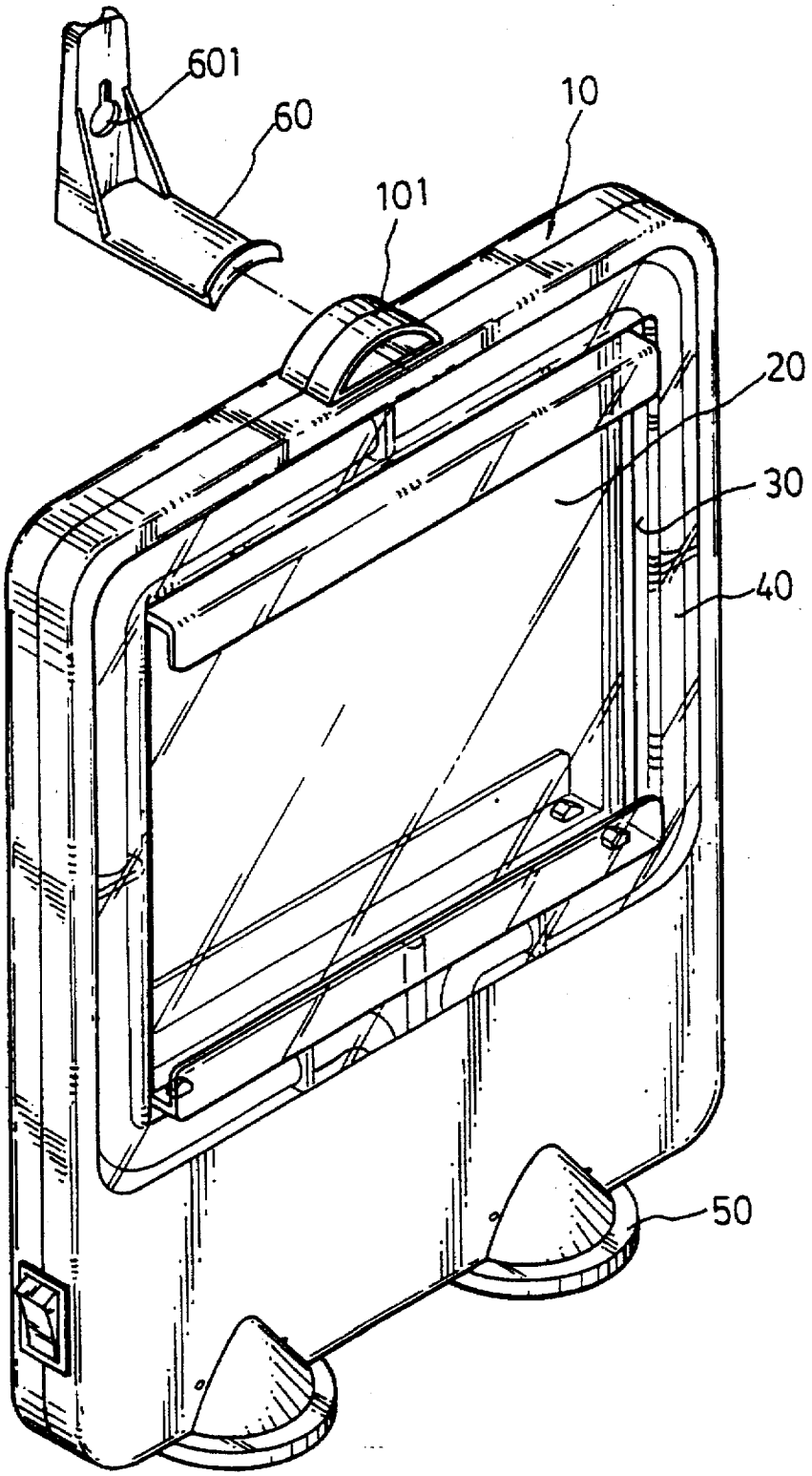
FIG. 4 illustrates a first working view of the present invention.

As shown in FIGS. 1 and 3, the top of the body portion 10 is provided with a curved projection 101 having an opening therein so that the body portion 10 can be hung when required. The two bases 50 are arranged on the bottom side of the body portion 10 for increasing the stability of the present invention. As illustrated, the base 50 includes a circular member 51 and a pair of lugs 52 and 53 having two protuberance 521 and 531 at the inner side thereof. The distance between the two lugs 52 is just equal to the thickness of the body portion 10. The base 50 is mounted on the bottom of the body portion 10, with its protuberances 521 and 531 engaged with respective holes 102 of the body portion 10.

Figure 5:
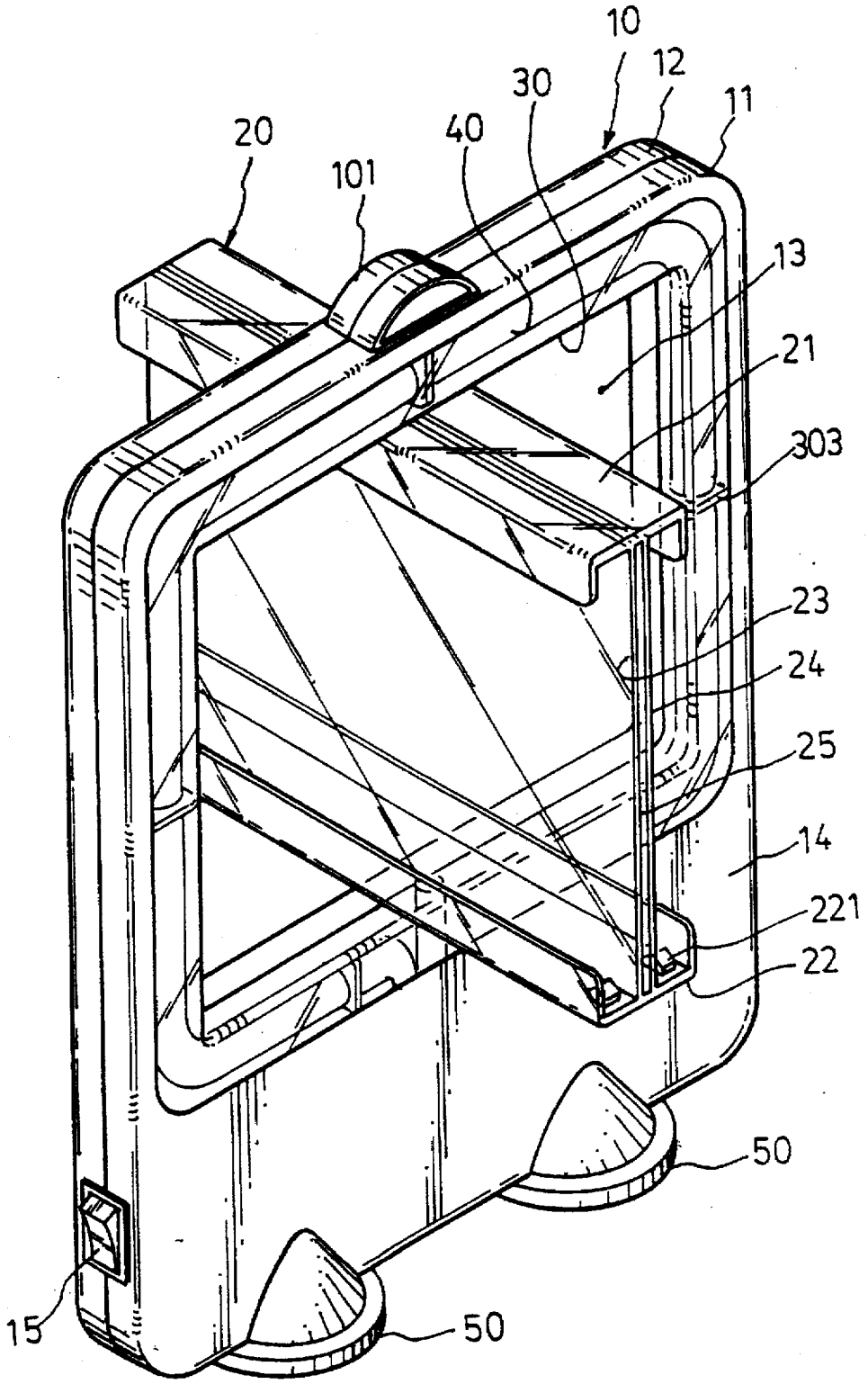
FIG. 5 illustrates a second working view of the present invention.

Turning to FIG. 5, a L-shaped member 60 having a keyhole 601 may be inserted through the curved projection 101 of the body portion 10 so as to make it easier to hang the present invention.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A multi-purpose displaying stand comprising:

a body portion having a rectangular opening at an upper portion thereof;

an electrical receptacle arranged within a lower portion of said body portion;

a power switch electrically connected with said electrical receptacle and fitted at one side of said body portion;

an electrical socket installed at another side of said body portion;

a transparent frame fixedly fitted within said rectangular opening of said body portion, said transparent frame being provided with a plurality of holding members;

a neon light mounted within said transparent frame and kept in place by said holding members, said neon light being electrically connected with said electrical receptacle; and a rotatable holder pivotally fitted within said transparent frame and having an inverted U-shaped top panel, a U-shaped bottom panel, a front and a rear vertical panels between said top and bottom panels, said front and second rear panels having a slot therebetween.

2. The multi-purpose displaying stand as claimed in claim 1, further comprising a plurality of bases each having two upwardly extending lugs adapted to receive a bottom of said body portion.

3. The multi-purpose displaying stand as claimed in claim 1, wherein said body portion has a curved member formed with a hole at a top thereof.

4. The multi-purpose displaying stand as claimed in claim 3, further comprising a L-shaped member having a keyhole and adapted to engage with the hole of said curved member.

* * * * *